United States Patent [19]

Doolan et al.

[11] Patent Number: 4,976,122

[45] Date of Patent: Dec. 11, 1990

[54] DEADBOLT ASSEMBLY HAVING SELECTABLE BACKSET

[75] Inventors: Martin P. Doolan, Duncanville; Dale R. Duvall, Keller, both of Tex.; Norbert J. Guetle, Jr., Cincinnati, Ohio; Ganesh Rajagopol, Richardson, Tex.

[73] Assignee: Pease Industries, Inc., Fairfield, Ohio

[21] Appl. No.: 420,298

[22] Filed: Oct. 12, 1989

Related U.S. Application Data

[63] Continuation-in-part of Ser. No. 231,423, Aug. 15, 1988, abandoned.

[51] Int. Cl.[5] ..... E05B 9/00

[52] U.S. Cl. ..... 70/134; 70/461; 292/337; 292/DIG. 74

[58] Field of Search ..... 70/134, 461; 292/337, 292/DIG. 74, DIG. 60, 1

[56] References Cited

U.S. PATENT DOCUMENTS

| | | | |
|---|---|---|---|
| 2,674,481 | 4/1954 | Russell et al. | 292/337 X |
| 2,905,495 | 9/1959 | Adamson | 292/337 X |
| 2,961,264 | 11/1960 | Hillgren | 292/337 X |
| 4,483,162 | 11/1984 | Dunphy et al. | 70/134 |
| 4,739,638 | 4/1988 | Lin | 70/134 X |

*Primary Examiner*—Robert L. Wolfe
*Assistant Examiner*—Suzanne L. Dino
*Attorney, Agent, or Firm*—Wood, Herron & Evans

[57] ABSTRACT

A deadbolt lockset having a linkage between the bolt and the bolt housing. The attachment point between the bolt and the first link can be selected from among several attachment points, and the connection between the bolt housing and a second link can be selected from among several locations to give a selected backset and a selected throw. A particular feature is the capability to provide a substantially longer throw than with conventional deadbolt assemblies.

10 Claims, 3 Drawing Sheets

DEADBOLT ASSEMBLY HAVING SELECTABLE BACKSET

This application is a continuation-in-part of application Ser. No. 231,423 filed Aug. 15, 1988 now abandoned for Deadbolt Assembly Having Selectable Backset.

BACKGROUND OF THE INVENTION

1. Field of the Invention

This invention relates to deadbolt locksets. More particularly, the invention relates to deadbolt locksets in which the backset is adjustable prior to installation.

2. Description of the Prior Art

Deadbolt locksets typically have a backset of two and three eighths inches or two and three quarters inches. The backset is the distance from the edge of the door to the axis of the actuating knob. When a deadbolt lockset is to be replaced, a new lockset having the same backset must be used. Adjustable locksets alleviate the problem of determining which size to use, and also allow for smaller inventories.

The throw of a bolt is defined as the distance the bolt travels from its retracted portion to its extended position, or the distance the bolt extends out of the bolt housing when the bolt is in its extended position. In some applications, an extra length of throW is required. As an example, a deadbolt lockset may be mounted in a pair of doors, where the bolt must travel out of one door and into the other in order to lock both doors. The bolt may also have to pass through a partition between the two doors. It is important that the total throw of the bolt be maintained, regardless of the selected backset.

Several types of adjustable deadbolt locksets have been used in the past. Some of these prior art devices are difficult to adjust, and some are very complicated and expensive. For a deadbolt lockset to be commercially acceptable, the lockset must be inexpensive and the backset easy to adjust.

SUMMARY OF THE INVENTION

The apparatus of the present invention is a deadbolt lockset in which the backset, can be selected prior to installation. The assembly includes a bolt, mounted for reciprocal movement in a bolt housing between a retracted position within the bolt housing and an extended position in which at least a portion of the bolt extends out of the bolt housing. In the extended position the bolt must extend at least a certain distance for the locking action to be effective. This effective distance, or throw, must be maintained regardless of the backset selected. A particularly useful feature of the deadbolt assembly of the invention is that it is capable of a throw which is substantially longer than the one-inch throw that is currently standard in the housing industry, and a related feature is that the throw distance can be readily changed prior to installation.

The deadbolt assembly of the invention includes an operating lever having one end mounted for pivotal movement in a cradle member which is movable in the housing but which is provided with means for latching it to the housing in each of a selected plurality of positions corresponding to standard backset distances. Pivotal movement of this lever, which is effected through the operating shaft of the assembly by a knob or key, causes the arm portion of the lever to oscillate.

The free end of this arm is pivotally connected to the rearward end of a link having its forward end pivotally attached to a selected one of several attachment points spaced longitudinally along the bolt by a pin which can be easily removed and replaced. The link can thus be easily detached from one point on the belt and reattached at a different point in accordance with the backset position of the cradle wherein the lever is mounted.

The desired long throw of the bolt is obtained by appropriate dimensioning of the lever arm, and this throw is maintained in all backset positions. More specifically, each point for pivotal attachment of the link to the bolt corresponds to a latched position of the cradle in the housing, e.g. if the cradle is latched in its forward position in the housing, the link is attached to the forward attachment point on the bolt, and so forth. In addition, provision is made for changing the pivotal connection between the link and the lever in order to change the length of the throw.

The bolt is provided with structure for substantially elimination vertical tilting movement of the bolt as it is moved from the retracted position, to the extended position thus assuring alignment of the bolt with receiving means in the jamb opposite to edge of the door.

DESCRIPTION OF THE PREFERRED EMBODIMENT

Figure 1:
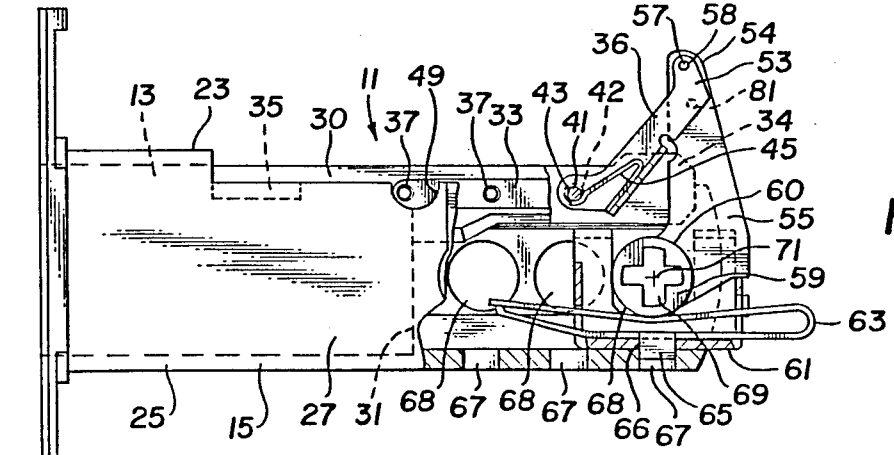
FIG. 1 is a side view of the preferred embodiment of the invention, partially in section, with the bolt in the retracted position and with the deadbolt set for a backset of two and three quarters inches.

The preferred embodiment of the invention is a deadbolt assembly 11 wherein a bolt 13 is mounted within a bolt housing 15. The bolt 13 is reciprocable between a retracted position within the housing 15, as shown in FIG. 1, and an extended position, shown in FIG. 2. In the extended position, a portion of the bolt 13 extends out of the bolt housing 15. In the embodiment shown, the bolt 13 extends at least one and three eighths inches out of the housing 15. The distance that the bolt 13 extends out of the housing 15 is called the "throw".

Figure 3:
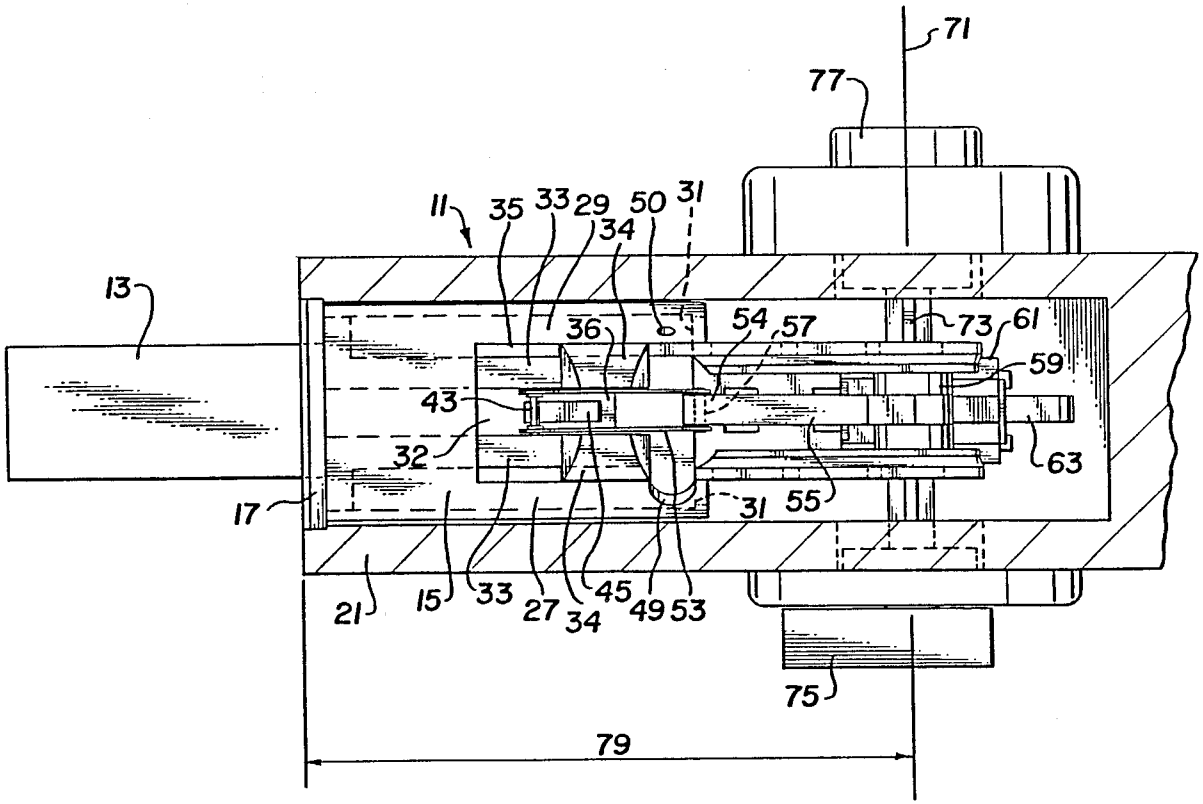
FIG. 3 is a top view of the preferred embodiment of the invention, with the bolt in the extended position and with the deadbolt set for a backset of two and three quarters inches.
Figure 4:
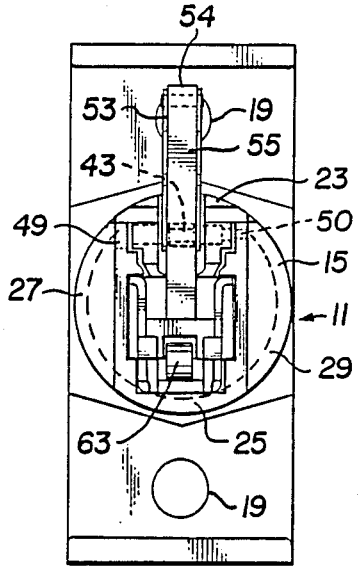
FIG. 4 is an end view of the preferred embodiment of the invention looking from right to left in FIG. 6.

A face plate 17 is located on the end of the bolt housing 15. The face plate 17 has a pair of holes 19, seen in FIG. 4, so that the face plate 17 can be screwed to a door 21 to hold the assembly 11 in place. The bolt housing 15 is hollow and has a top 23, a bottom 25, and two sides 27 and 29. As best shown in FIG. 3, the top 23 of the housing 15 extends only partially down the length of the housing 15, leaving a slot 30. The housing 15 has a pair of shoulders 31 that restrict the rearward travel of the bolt 13, thus defining the retracted position of the bolt 13.

The bolt 13 has a longitudinal slot 32 in its rearward end which provides a pair of extension members 33 that extend rearward. Each extension member 33 has a wing 34 that rides along the upper edge of the slot 30. The wings 34 prevent vertical tilting movement of the bolt 13 a the bolt 13 is move from the retracted position to the extended position. Thus, alignment is assured between the bolt 13 and the keeper in the associated jamb or other door.

Figure 2:
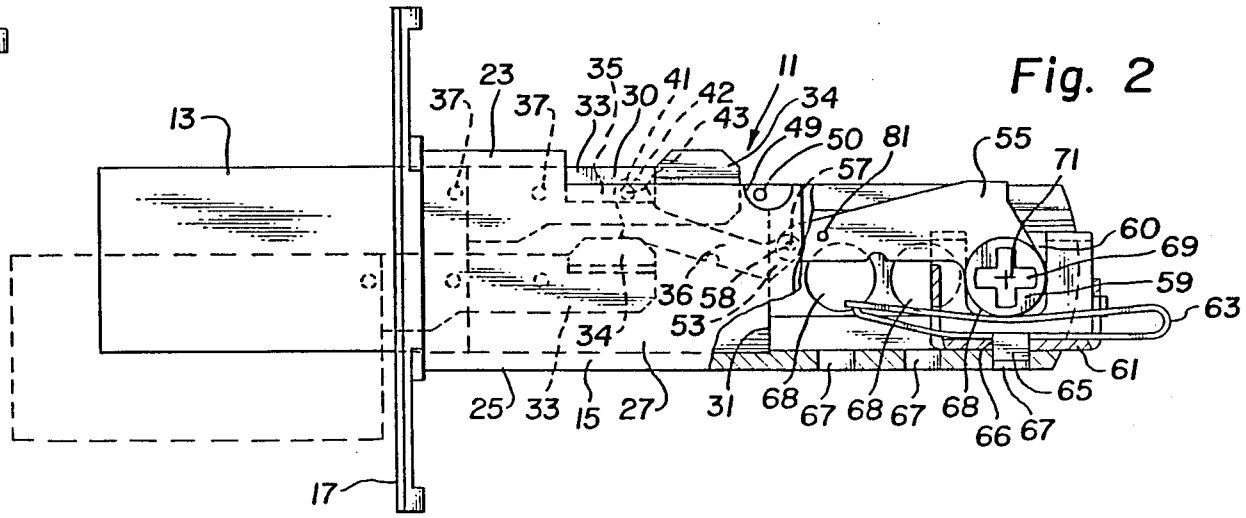
FIG. 2 is a side view of the preferred embodiment of the invention, partially in section, with the bolt in the extended position and with the deadbolt set for a backset of two and three quarters inches, and with the bolt also shown in phantom to illustrate of the bolt into the bolt housing.

The slot 30 is enlarged at the forward end to provide an aperture 35 that is larger than the wings 34. Thus, as shown in FIG. 2 in shadow lines, during manufacture the bolt 13 can be inserted into the bolt housing 15 by passing the wings 34 through the aperture 35 in the slot 30.

A link 36 is attached to the extension members 33 of the bolt 13. Three sets of aligned holes 37 are longitudinally spaced along the extension members 33 of the bolt 13. The link 36 fits into the slot 32 between the extension members 33 of the bolt 13, so that a hole 41 in the end 42 of the link 36 can be aligned with each of the sets of holes 37 in the extension members 33. The three sets of holes 37 in the extension members 33 of the bolt 13 thus provide a plurality of attachment points for the link 36.

An attachment pin 43 passes through the selected one of the sets of holes 37 in the extension members 33 and through the hole 41 in the end 42 of the link 36 to form a pivotal connection between the link 36 and the bolt 13. A U-shaped leaf spring 45 fits within a groove 47 (FIG. 5) around the pin 43 to hold the pin 43 in place. The spring 45 can be depressed and removed when the pivotal mounting of link 36 is to be changed.

Figure 5:
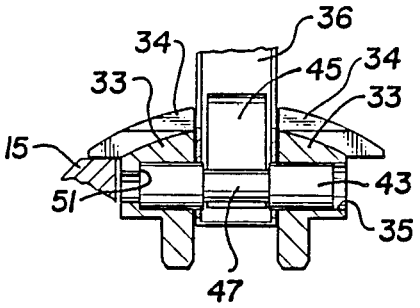
FIG. 5 is a sectional view of the deadbolt shown in FIG. 6, as seen along lines 5—5 in FIG. 6 and on a larger scale to illustrate the attachment pin.
Figure 7:
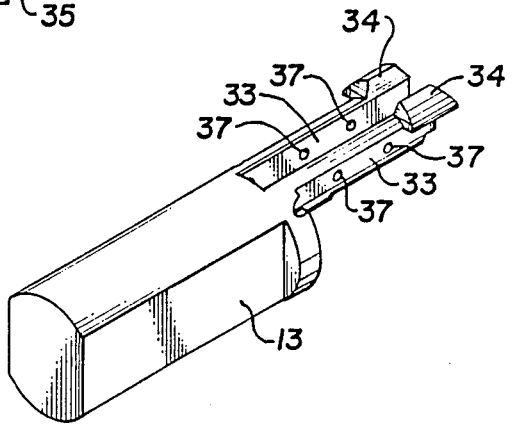
FIG. 7 is a perspective view of the bolt of the preferred embodiment of the invention.

With the spring 45 removed, the bolt 13 can then be moved to align the pin 43 with a slot 49 in one side 27 of the housing 15 and a hole 50 in the other side 29 of the housing 15. A narrow object, such as a paper clip or pin, can be inserted through the hole 50 to push the pin 43 out of the hole 41 in the first link 36 and the holes 37 in the extension members 33 of the bolt 13. As shown in FIG. 5, each of the holes 37 in one of the extension members 33 has a shoulder 51 to prevent the pin 43 from passing through the bolt 13 in one direction.

The opposite end 53 of the link 36 is pivotally connected to the arm 54 of the operating lever 55 by a pivot pin 57 extending through a hole 58 in the lever arm 54. The link 36 and lever 55 can therefore pivot relative; to one another about the pin 57. The opposite end of the lever 55 includes a pair of cylindrical hubs or stub axles 59 which are rotatably supported in U-shaped slots 60 in the opposite side walls of a cradle member 61 that is in turn releasably latched to the bolt housing 15 by a spring clip 63.

More specifically, the spring clip 63 includes a pair of downwardly extending tabs 65 which extend through- a hole 66 in the bottom of cradle member 61 for latched engagement in a selected one of several holes 67 in the bottom 25 of the housing 15. Each of these holes 67 has a related cylindrical hole 68 through the sides 27 and 29 of the housing 15. When the cradle member 61 is latched to one of the holes 67 by the spring clip 63 and table 65, the stub axles 59 on the lever 55 will be aligned with a corresponding pair of aligned holes 68 in the side walls of the housing 15.

A cross-shaped passage 69 passes through the stub axles 59 of the lever 55. The lever 55 is pivotable in the cradle member 61 around an axis 71 through the center of the passage 69. As shown in FIG. 3, actuating shaft means in the form of a tail piece 73, which may be flat or cross-shaped in section, passes through the passage 69, so that the lever 55 can be pivoted back and forth. The tail piece 73 is pivoted by a knob 75 or by a key inserted into a lock 77. The lever 55 is shown in FIG. 3 in the unlocking position, and the bolt 13 is in its retracted position.

Figure 6:
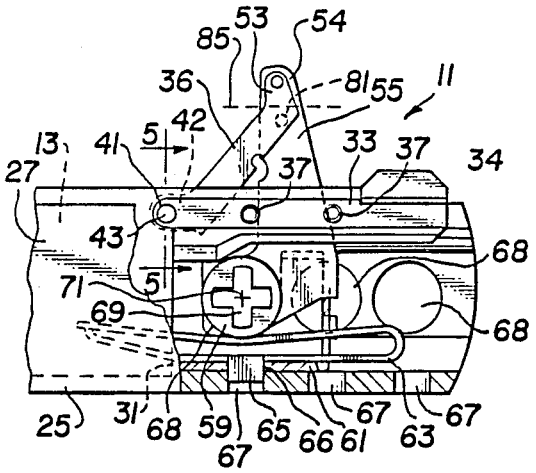
FIG. 6 is a partial side view of the preferred embodiment of the invention, partially in section, with the bolt in the retracted position and with the deadbolt set for a backset of two inches.

The distance between the face plate 17 and the axis 71 of the tail piece 73 is called the "backset" 79. The backset 79 of the assembly 11 can be selected by placing the tabs 65 of the spring clip 63 in a selected one of the holes 67 in the bottom 25 of the housing 15. When the tabs 65 of the spring clip 63 are in the rearward hole 67, as shown in FIGS. 1–3, the backset 79 is two and three quarters inches. In FIG. 6, the backset 79 is set at two inches, because the tabs 65 of the spring clip 63 are in the forward hole 67. The middle hole 67 is for a backset 79 of two and three eighths inches.

The backset 79 can be adjusted by moving the spring clip 63 to position the tabs 65 in a selected hole 67. A sharp object can be used to push upward on the spring clip 63 until the tabs 65 are out of the hole 67. The spring clip 63, the cradle member 61, and the lever 55 are then moved to the selected other hole 67, where the tabs 65 snap down into the hole 67. In order to maintain a constant throw, the link 36 must then be moved to a different attachment point. The bolt 13 is moved longitudinally until the attachment pin 43 is aligned with the slot 49 and the hole 50 in the housing 15. The spring 45 is depressed and removed from engagement with the pin 43. A narrow object is then inserted through the hole 50 in the housing 15 to push the pin 43 out of the holes 35 in the extension members 33 and the hole 41 in the end 42 of the link 36. The bolt 13 is then moved to align a different set of holes 37 with the slot 31 and the hole 41 in the link 36. The pin 43 is then reinserted, and the spring 45 is replaced.

The throw can be changed in the following manner. The lever 55 has an alternate hole 81 slightly offset from the first hole 58. The pivot pin 57 can be removed and replaced through the alternate hole 81. The end 54 of the lever 55 should then be cut off preferably along the line 85 in FIG. 6. The use of the alternate hole 81 will result in a shorter throw of the bolt 13.

The apparatus of the invention has several advantages over the prior art. The assembly 11 provides for a selection of several different backsets 79 and throws. The throw and the backset 79 can be changed easily, without special tools or skill. Further, the assembly 11 of the invention provides longer throw than prior art devices, and maintains the longer throw regardless of the backset selected. More specifically, the invention provides a one and three eighths inch throw, even with a minimal backset of only two inches. The assembly 11 also can be manufactured simply and inexpensively.

A particular advantage of this assembly is that it makes possible a throw considerably in excess of the conventional one-inch throw even with a back set of only two inches. More specifically, with the bolt 13 having an overall length of two and one half inches, including the extensions 33, and with the other parts shown in the drawings in the same proportion to a bolt of that length, it is possible and practical to obtain a throw of one and three eighths inches.

This advantage results from the particular structure and cooperative action of the link 36 and lever 55 together with the slotted construction of the rearward end of the bolt which provides the necessary space for accommodating the operating mechanism inside the outline of the rearward portion of the bolt. This is especially clearly illustrated in FIG. 6, which shows that in the retracted position of the bolt its rearward extensions 33 completely straddle the the link and lever and extend beyond the cradle member 61 wherein the lever 55 is pivotally supported while the lever 55 extends upwardly through the slot 30 in the top of the housing to provide for correspondingly increased linear travel of the pivot pin 57 and the link 36 than if the lever 55 would remain in the housing.

The invention has been described in only the preferred embodiment. Various changes and modifications may be made without departing from the spirit and scope of the invention as described by the appended claims.

We claim:

1. A deadbolt assembly adapted to be mounted in the edge of a door for actuation by shaft means having the axis thereof at one of a selected plurality of backset positions with respect to said door edge, comprising:

(a) a housing adapted to be mounted within the edge of a door and having top, bottom and side walls, (b) a bolt mounted for reciprocating movement in said housing between a retracted position within said housing and an extended position wherein a portion of said bolt extends out of said housing, (c) operating means for effecting said movement of said bolt including a lever arm having at one end thereof a pair of cylindrical hubs for receiving said shaft means therethrough, (d) a cradle supported for movement in said housing parallel with said bolt and including a bottom and side walls enclosing said lever, (e) said cradle side walls having recesses therein forming pivotal mountings for said lever hubs, (f) releasable means for latching said cradle to said housing in a selected one of a plurality of locations each corresponding to a predetermined backset position, (g) a link having forward and rearward ends, (h) means for pivotally connecting said rearward end of said link to said lever arm, (i) means for pivotally attaching said forward end of said link to said bolt at a selected one of a plurality of attachment points spaced longitudinally along said bolt to cause reciprocating movement of said bolt in response to oscillating movement of said lever arm, and (j) the relative spacing of said attachment points corresponding to the relative spacing of said locations of said cradle to provide for the same throw of said bolt in all of said backset positions of said cradle.

2. A deadbolt assembly as defined in claim 1 wherein said means for latching said cradle to said housing comprises a plurality of holes in said housing corresponding to said backset positions, and a spring-loaded tab carried by said cradle and proportioned for insertion in a selected one of said holes.

3. A deadbolt assembly as defined in claim 1 wherein said means for latching said cradle to said housing comprises a spring carried by said housing below said lever, a plurality of holes in said bottom wall of said housing spaced to correspond with said backset positions, and a tab carried by and extending downwardly from said spring for selective latching engagement in each of said holes.

4. A deadbolt assembly as defined in claim 1 wherein the portion of said bolt within said housing has a longitudinal slot therein providing a pair of rearward extensions which straddle said link and said lever arm, and said releasable attaching means comprises a pin received in a selected pair of aligned holes in said bolt-extensions and a hole in said forward end of said link.

5. A deadbolt assembly as defined in claim 4 further comprising means providing a pair of apertures in said housing side walls which are aligned with each other and adapted to be selectively aligned with each of said pairs of holes in said bolt extensions to facilitate transfer of said pin from one of said pairs of holes to another.

6. A deadbolt assembly as defined in claim 4 wherein said housing includes an upper wall having a slot extending longitudinally thereof, and each of said rearwardly extending members includes a wing on the inner end thereof which projects laterally outwardly thereof and overlies and rides on the adjacent edge of said housing slot during movement of said bolt from said retracted position to said extended position thereof and thereby prevents tilting of said bolt in a vertical plane during such movement.

7. A deadbolt assembly as defined in claim 5 wherein said housing slot includes a wide portion at the front end thereof for receiving said wings therethrough during assembly of said bolt into said housing.

8. A deadbolt assembly as defined in claim 1 further comprising means providing a plurality of locations on said lever arm for said means for pivotally connecting said rearward end of said link to said lever arm in order to vary the throw of said bolt.

9. A deadbolt assembly as defined in claim 1 wherein said housing includes an upper wall having a slot extending longitudinally thereof, and said lever arm being supported for oscillating movement between positions on opposite sides of the vertical and is of such length as to extend through and above said slot in said vertical position to provide a correspondingly long throw for said bolt.

10. A deadbolt assembly adapted to be mounted in the edge of a door for actuation by shaft means having the axis thereof at one of a selected plurality of backset positions with respect to said door edge, comprising:

(a) a housing adapted to be mounted within the edge of a door and having top, bottom and side walls, (b) a bolt mounted for reciprocating movement in said housing between a retracted position within said housing and an extended position wherein a portion of said bolt extends out of said housing, (c) operating means for effecting said movement of said bolt including a lever arm having at one end thereof a pair of cylindrical hubs for receiving said shaft means therethrough, (d) a cradle supported for movement in said housing parallel with said bolt and including a bottom and side walls enclosing said lever, (e) said cradle side walls having recesses therein forming pivotal mountings for said lever hubs, (f) releasable means for latching said cradle to said housing in a selected one of a plurality of locations each corresponding to a predetermined backset position, (g) said releasable latching means comprising a spring carried by said housing below said lever, a plurality of holes in said bottom wall of said housing spaced to correspond with said backset positions, and a tab carried by and extending downwardly from said spring for selective latching engagement in each of said holes, (h) a link having forward and rearward ends, (i) means for pivotally connecting said rearward end of said link to said lever arm, (j) the portion of said bolt within said housing having a longitudinal slot therein providing a pair of rearward extensions which straddle said link and said lever arm, (k) said bolt extensions having pairs of aligned holes therein which are spaced longitudinally thereof, (l) a pin sized for removable insertion in each of said pairs of holes and in a hole in said forward end of said link to form a pivotal connection between said link and said bolt, and (m) the relative spacing of said pairs of holes in said bolt extensions corresponding to the relative spacing of said holes in said bottom wall of said housing to provide for the same throw of said bolt in all of said backset positions of said cradle.

* * * * *

UNITED STATES PATENT AND TRADEMARK OFFICE

CERTIFICATE OF CORRECTION

PATENT NO. : 4,976,122

DATED : December 11, 1990

INVENTOR(S) : Martin Doolan et al.

It is certified that error appears in the above-identified patent and that said Letters Patent is hereby corrected as shown below:

Col. 1, line 28, "throW" should be --throw--.

Col. 1, line 45, delete the comma after backset.

Col. 2, line 21, "elimination" should be --eliminating--.

Col. 2, line 24, "to" should be --the--.

Col. 2, line 35, after "illustrate" insert --assembly--.

Col. 3, line 13, after "13" first occurrence, "a" should be --as--

Col. 3, line 13, "move" should be --moved--.

Col. 3, line 54, after "relative" remove the semicolon.

Col. 3, line 62, after "through" remove the hyphen.

Col. 4, line 1, "table" should be --tabs--.

Col. 5, line 12, "the" second occurrence, should be deleted.

Signed and Sealed this

Eighth Day of September, 1992

*Attest:*

DOUGLAS B. COMER

*Attesting Officer*

*Acting Commissioner of Patents and Trademarks*